United States Patent [19]

Ellis

[11] Patent Number: 4,896,714

[45] Date of Patent: Jan. 30, 1990

[54] ROLL DOOR

[75] Inventor: Arthur S. Ellis, Brampton, Canada

[73] Assignee: Hy-Roll Manufacturing, Inc., Ontario, Canada

[21] Appl. No.: 30,034

[22] Filed: Mar. 24, 1987

[51] Int. Cl.[4] ..... E06B 9/08

[52] U.S. Cl. ..... 160/311; 160/264

[58] Field of Search ..... 160/311, 201, 265, 238, 160/320, 310, 264; 49/27, 28

[56] References Cited

U.S. PATENT DOCUMENTS

| | | | |
|---|---|---|---|
| 15,447 | 7/1856 | Wearer . | |
| 1,550,237 | 8/1925 | Beckman . | |
| 3,154,303 | 10/1964 | Cavallero et al. | 49/27 X |
| 3,460,602 | 8/1969 | Hugus | 160/265 |
| 3,710,050 | 1/1973 | Richards | 49/28 X |
| 3,878,879 | 4/1975 | Manns | 160/285 |
| 4,133,365 | 1/1979 | Schleicher | 49/28 X |
| 4,369,344 | 1/1983 | Diamond | 49/27 X |

FOREIGN PATENT DOCUMENTS

| | | | |
|---|---|---|---|
| 3245009 | 6/1984 | Fed. Rep. of Germany | 160/311 |

OTHER PUBLICATIONS

Brochure–Kelley Rapid Roll Door–Form 20–210.

*Primary Examiner*—Blair M. Johnson

*Attorney, Agent, or Firm*—Fay, Sharpe, Beall, Fagan, Minnich & McKee

[57] ABSTRACT

A roll door assembly has a flexible roll door rollingly supported in a frame; a counterweight assembly employing fixed and movable pulleys and a counterweight retains the roll door taut.

4 Claims, 4 Drawing Sheets

ROLL DOOR

BACKGROUND OF THE INVENTION (i) Field of the Invention

This invention relates to a roll door assembly, more especially a roll door assembly for mounting in an open doorway of a commercial or industrial building.

(ii) Description of the Prior Art

Commercial and industrial buildings have large doorways or openings for passage of vehicles such as forklift trucks and other traffic. It is desirable to seal such openings closed when not in use in order to reduce loss of heat from a heated area to a non-heated or cold area, to maintain particular atmospheric conditions and temperatures in specialized environments, to maintain worker comfort and for other purposes.

Flexible doors have been developed for this purpose which hang down to close the opening but may be rolled up to permit access through the doorway or opening. In particular, the flexible roll door is supported on a rotatable shaft disposed across the top of the door opening and is unwound from or wound on the shaft to close or open the doorway. For this purpose the shaft is driven by a motor, the direction of rotation of the shaft determining whether the roll door is unwound from or wound on the shaft.

Since the door is necessarily of flexible material, to enable it to be rolled on and off the shaft, it is necessary to provide some means for tensioning the flexible material so that it is retained tau.. For this purpose it has previously been proposed to employ a heavy spring under tension to counterbalance the weight of the roll door and hold it taut.

Such springs display several disadvantages. In particular, the tensioning force applied by the spring is not uniform but varies with the load which it is counterbalancing, so that a uniform counterbalancing force is not applied throughout the vertical travel of the roll door.

Springs deteriorate with use and age and this also results in variation of the counterbalancing force.

Furthermore, a heavy spring maintained in a tensioned state represents a potential hazard in the event that the spring breaks free.

SUMMARY OF THE INVENTION

It is an object of the present invention to overcome the disadvantages associated with the use of a heavy spring while applying a uniform non-hazardous counterbalancing force.

In accordance with the invention, a roll door assembly comprises a frame, rotatable support means for a flexible roll door mounted in the frame and a flexible roll door rollingly supported on the support means. A counterweight means is adapted to retain the flexible roll door taut, the counterweight means being mounted for vertical counterbalancing movement responsive to rolling movement of the door. Drive means rotates the support means.

Thus the roll door has a closed door configuration in which the roll door is in an unrolled or unwound configuration extending vertically downwardly to the floor, and an open door configuration in which the roll door is rolled or wound on the rotatable support means.

The support means is in particular a shaft rotatably driven by an electro-hydraulic motor whereby the direction of rotation of the shaft can be readily changed, such that the direction of travel of the roll door can be readily changed.

It will be understood that references to the roll door being rollingly supported on the support means or shaft are intended to indicate that the roll door is rolled or wound on the support means and can be unwound from or wound on the support means by appropriate rotation thereof.

BRIEF DESCRIPTION OF THE DRAWINGS

The invention is illustrated in particular and preferred embodiments by reference to the accompanying drawings in which.

DESCRIPTION OF PREFERRED EMBODIMENTS WITH REFERENCE TO THE DRAWINGS

Figure 1:
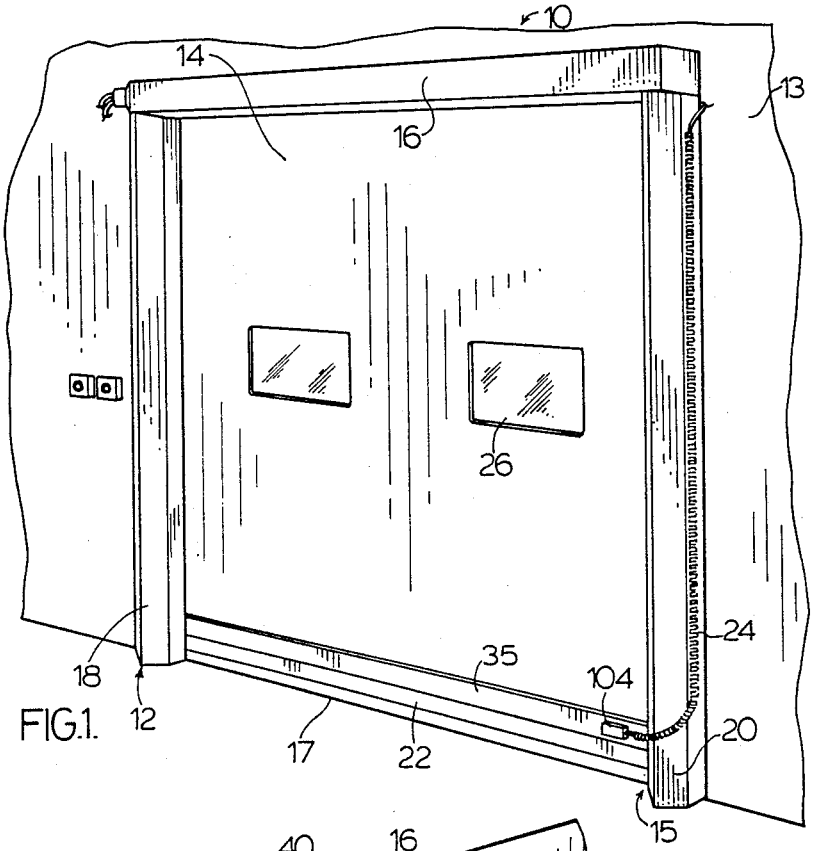
FIG. 1 is a perspective view of a door assembly of the invention, in the closed configuration.

With further reference to FIG. 1, a roll door assembly 10 includes a frame 12 and a roll door 14. A door space 15 in a wall 13 is surrounded by frame 12 and is designed to be closed by roll door 14. In particular frame 12 is mounted to the face of the wall 13 surrounding opening 15, not within opening 15.

Frame 12 includes a frame or cover 16 and side frame members 18 and 20 respectively.

Roll door 14 has an outer or lower end 17 supporting a safety bar 22 having a signal conduction cord 24. Flexible window panels 26 or clear PVC or the like are formed in roll door 14.

Figure 3:
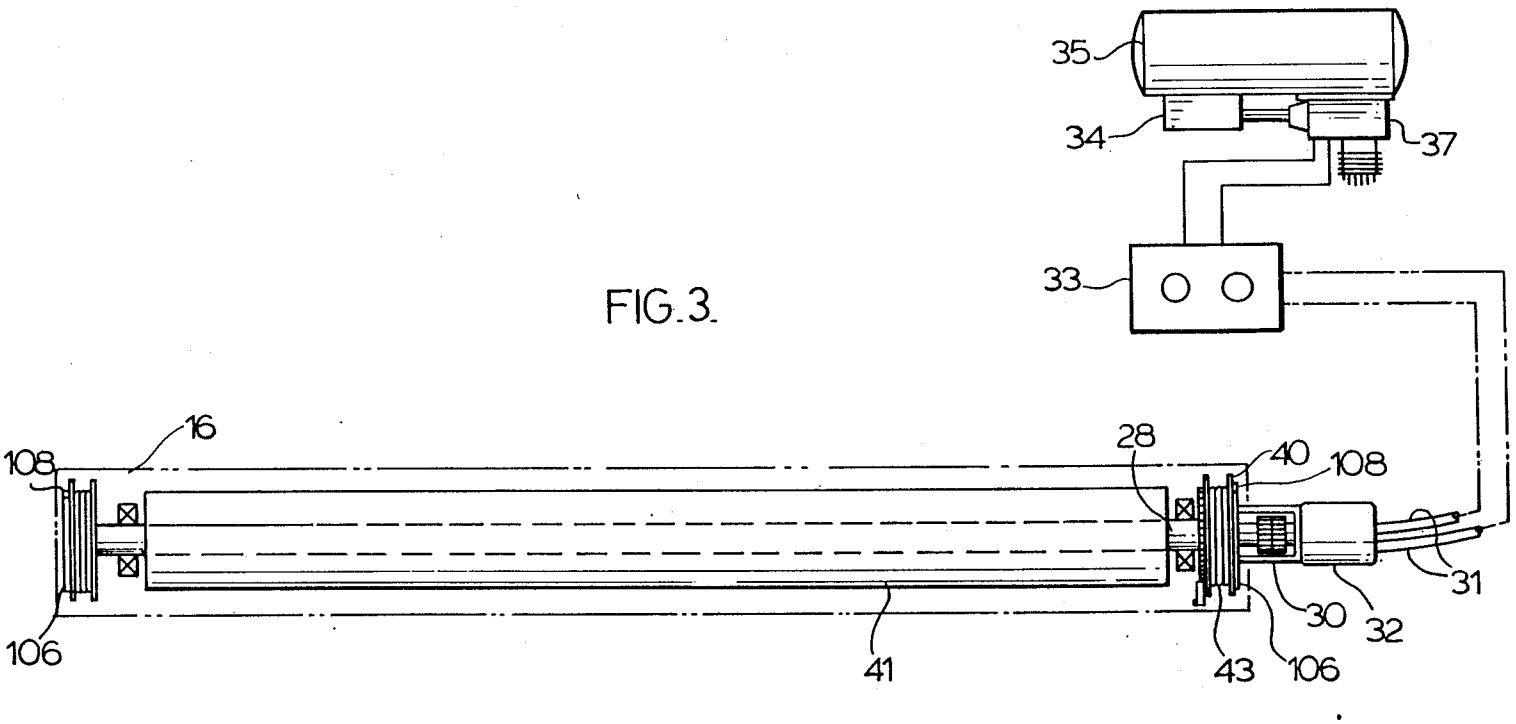
FIG. 3 is a schematic top plan view of the door assembly of FIG. 1.

With particular reference to FIG. 3, roll door 14 is rollingly supported on a shaft 28 coupled by a coupling 30, for example, a chain coupling, to a hydraulic motor 32 connected by hydraulic lines 31 through a valve 33 to a pump 37 having a reservoir 35, the pump 37 being driven by an electric motor 34.

With further reference to FIG. 1, each of the side frame members 18 and 20 houses a counterweight assembly 36. The assemblies 36 in the side frame members 18 and 20 are identical and will be further described by reference to the counterweight assembly 36 in side frame member 18, more particularly shown in FIG. 2.

Side frame member 18 includes a frame wall 62 and a frame cover 64 hingedly mounted thereon by hinges 60. Frame wall 62 is secured to a face portion of wall 13 (see FIG. 1) adjacent opening 15 which is to be closed by roll door 14.

The hingedly mounted frame cover 64 permits ready access to the counterweight assembly 36.

Figure 2:
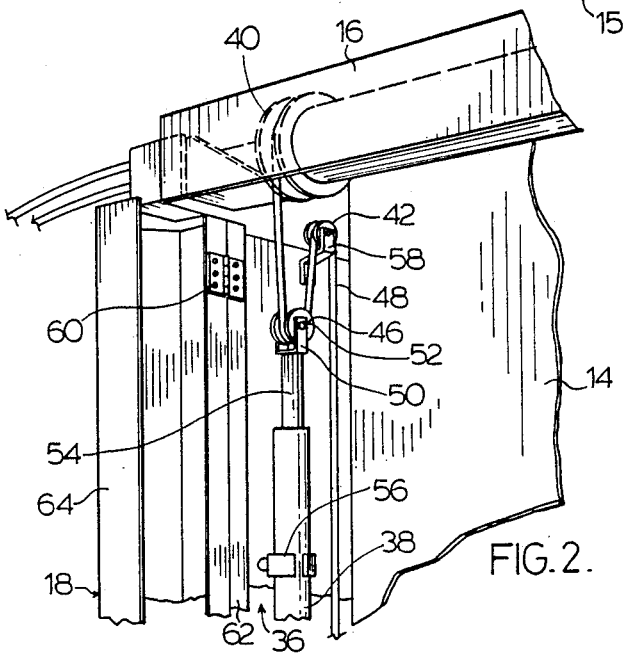
FIG. 2 is a partial view, of the upper left side of the door assembly of FIG. 1.
Figure 4:
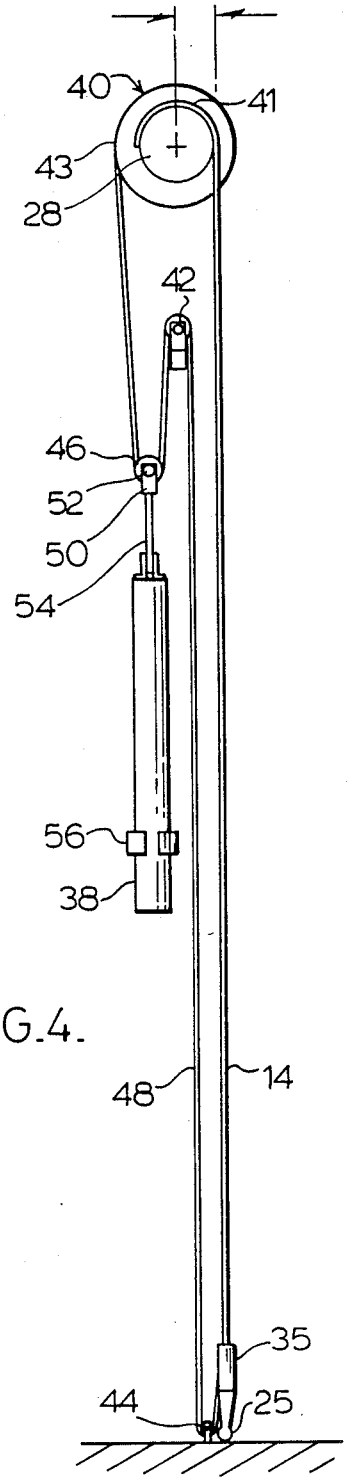
FIG. 4 is a schematic side elevation of the flexible door and counterbalancing assembly in the closed configuration.
Figure 5:
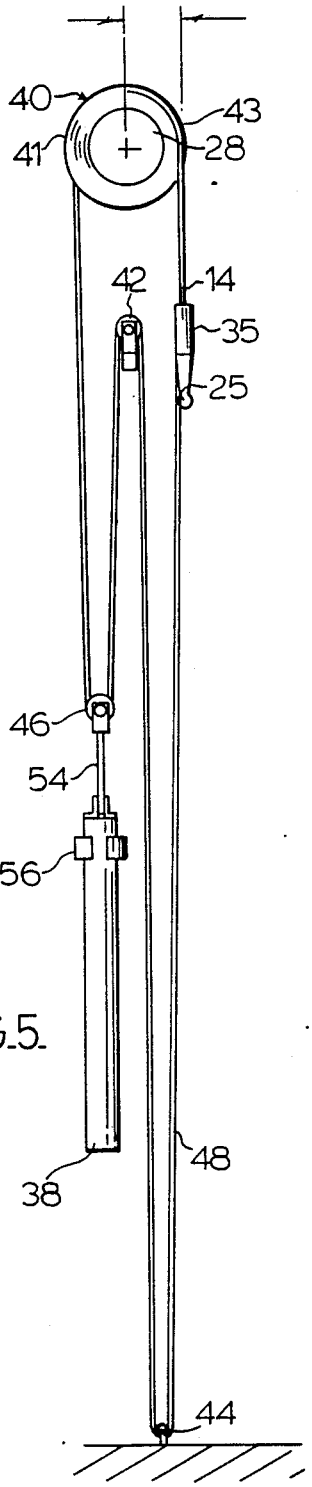
FIG. 5 is a schematic side elevation similar to FIG. 4 in the open configuration.

With further reference to FIGS. 2, 4 and 5, each counterweight assembly 36 includes a counterweight 38, which is in particular an elongated cylinder, a spool 40, an upper fixed pulley 42, a lower fixed pulley 44, a movable pulley 46, and a belt 48.

Spool 40 is mounted on the same axis of rotation as shaft 28.

Movable pulley 46 is rotatably mounted in a shackle 50 about a shackle pin 52, and shackle 50 is secured to an upper end of counterweight 38 by a link 54. Guides 56 are mounted on frame wall 62 partially circumventing counterweight 38.

Upper fixed pulley 42 is rotatably supported between frame wall 62 and an arm 58 secured to wall 62.

Belt 48 is entrained about the counterweight assembly 36. In particular, belt 48 is secured at one end to spool-. 40 and is partially wound thereon. Belt 48 drops from spool 40, passes under movable pulley 46 and rises to upper fixed pulley 42. Belt 48 passes over upper fixed pulley 42 and then drops to lower fixed pulley 44. Belt 48 passes under fixed pulley 44 and is attached to outer end 17 of roll door 14. In this way, counterweight 38 is suspended or hangs vertically and is vertically movable being raised or lowered responsive to lowering or raising of flexible door 14 to counterbalance the hanging weight of door 14 and hold it taut.

A ratchet 106 is mounted on each end of shaft 28 adjacent a spool 40, and a cooperating dog or pawl 108 for each ratchet 106 is pivotally mounted on frame 16. Pawl 108 cooperates with ratchet 106 during assembly of roll door assembly 10 to restrict rotation of shaft 28 to one direction so that the belts 48 can be wound on spools 40 and adjusted to appropriate positions for location of the counterweights 38 relative to outer end 17 of roll door 14. When assembly is complete the pivotal connection of pawl 108 to frame 16 is released and pawl 108 is locked to ratchet 106 to rotate therewith.

In the closed door configuration of FIG. 4, the door 14 is lowered; in this configuration the wound portion of flexible door 14 on shaft 28 forms a wound roll 41 of small diameter and the wound portion of belt 48 on spool 40 forms a winding 43 of large diameter, in this configuration the hanging weight of the door is at its greatest.

In the open door configuration of FIG. 5, wound roll 41 is of large diameter and winding 43 on spool 40 is of small diameter; in this configuration the hanging weight of the door is at its least.

As the diameter of wound roll 41 increases there is a corresponding decrease in the hanging weight of flexible door 14 and in the diameter of winding 43. As the diameter of wound roll 41 decreases there is a corresponding increase in the hanging weight of flexible door 14 and in the diameter of winding 43.

A uniform counterbalancing of flexible door 14 is achieved throughout the travel of door 14 by the balancing moment created by counterweight 38 and winding 43 on the one hand, and the hanging weight of door 14 and wound roll 41 on the other.

Figure 6:
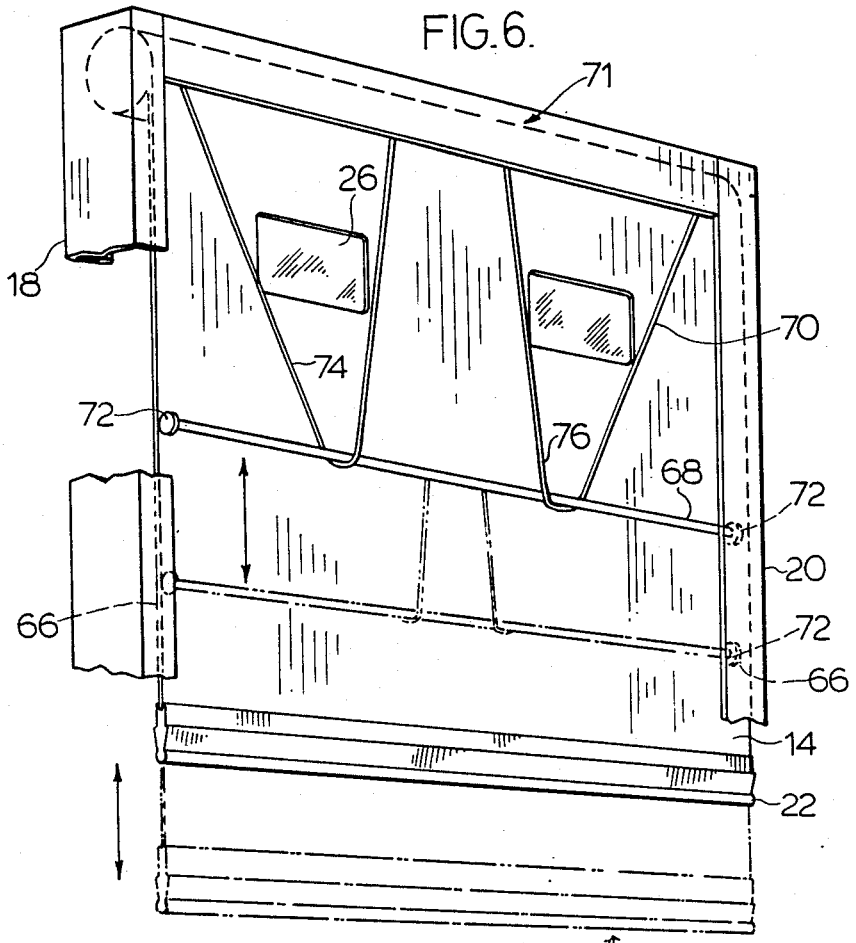
FIG. 6 is a partial schematic perspective of a door assembly of the invention in another embodiment illustrating the raising and lowering of the flexible door, and FIGS. *7a* and *7b* illustrate schematically the automatic reversal of the downward movement of the flexible door in the event of an obstacle in the door opening.

With further reference to FIG. 6, a variation of the assembly of FIG. 1 is shown wherein side frame members 18 and 20 each have an opposed vertical side channel 66. A wind bar 68 extends across roll door 14, its extremities being freely housed in the side channels 66. Plugs 72 of Nylon or the like are supported in the ends of wind bar 68, the plugs each having a head for engagement with the walls of channels 66.

A pair of straps 70 and 71 have loops 74 and 76, respectively supporting wind bar 68. In particular the outer ends of straps 70 and 71 are secured to the cover 16, and inner ends (not shown) are secured to shaft 28 such that with the roll door 14 in the closed configuration closing door space 15, loops 74 and 76 hang downwardly under the weight of wind bar 68 which is disposed intermediate the upper and lower ends of the frame 12.

Figure 7A:
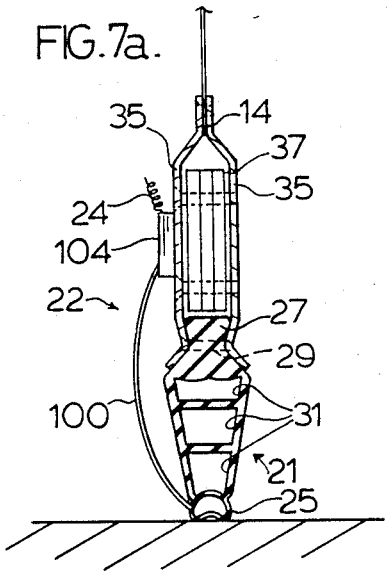
Figure 7B:
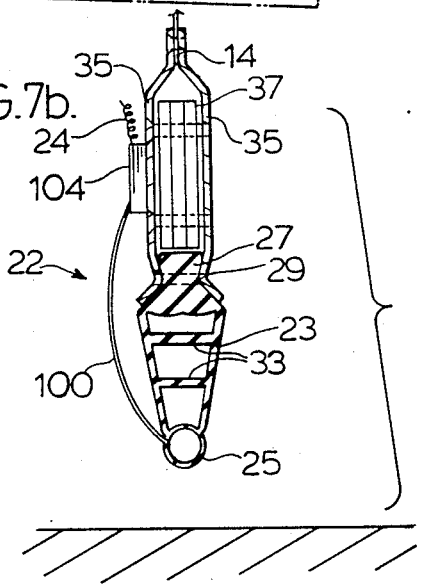

With reference to FIGS. 7*a* and 7*b*, there is shown a detail of the safety bar 22. Safety bar 22 includes a flexible rubber element 21 having a body 23, an air tube 25 at a lower end and a boss or head 27 having a neck 29 at an upper end. Body 23 comprises air compartments 31 separated by walls 33.

Opposed plate members 35 are secured as by riveting or the like to opposed sides of neck 29 and the outer end 17 of roll door 14. An elongate stiffener 37 is housed between plate members 35 and secured thereto by rivets or the like.

Thin flexible tubing 100 is in air flow communication with the interior of air tube 25, and connected to switch 104 mounted on one of the plate members 35. Signal conduction cord 24 connects switch 104 and motor 32.

FIG. 7*a* particularly illustrates a collision between safety bar 22 of descending door 14 and an obstacle 78. The collision deforms the pressure sensitive air tube 25 causing air to flow along tubing 100 to actuate switch 104 and a signal responsive to the deformation is conveyed by cord 24 to motor 32 reversing the direction of rotation of shaft 28 to raise door 14 as shown in FIG. 7*b*. Body 23 serves to absorb or cushion impact forces.

In operation, roll door 14 is raised and lowered to open and close door space 15 by rotating shaft 28 by means of motor 32 either to wind or roll the door 14 on the shaft 28 in the event that door space 15 is to be opened, or to unwind or unroll door 14 from shaft 28 in the event that door space 15 is to be closed.

The spools 40 of the counterweight assemblies 36 are mounted for rotation with shaft 28. The counterweight assemblies 36 serve to counterbalance the weight of the roll door 14 and to retain door 14 taut and in tension in the closed or any partially closed configuration, the roll door 14 being uniformally counterbalanced throughout its movement.

When roll door 14 is substantially completely fully wound or rolled on shaft 28, door space 15 is fully open. In this configuration, counterweight 38 is in its lowermost position, as shown in FIG. 5. As roll door 14 is unrolled from shaft 28 such that outer end 27 extends vertically downwardly between side frame members 18 and 20, belt 48 is wound onto spool 40 and movable pulley 46 carrying counterweight 38 rises to balance the weight of roll door 14.

Movable pulley 46, and with it counterweight 38, ascends in response to descent of roll door 14, belt 48 being wound on spool 40. Movable pulley 46, and with it counterweight 38, descends in response to ascent of roll door 14, belt 48 being unwound from spool 40. In this way a uniform counterbalancing of roll door 14 throughout its travel is provided. During such ascent or descent counterweight 38 is guided by guides 56.

By means of the hydraulic motor 32, the roll door 14 may be raised and lowered at, for example, 2 ft/sec. and the motor 32 can, if desired, be mounted separately away from door assembly 10 where space or noise requirements are a consideration. The motor 32 also permits smooth and ready reversal of the direction of rotation of shaft 28 so that the direction of travel of roll door 14 can be readily reversed.

The safety bar 22 functions to immediately reverse the downward travel of roll door 14 in the event of contact of bar 22 with any obstacle in space 15 above floor level. In particular, the pressure-sensitive air tube 25 is responsive to even slight pressure applied to such tube 25 as a result of contact of the tube 25 with an obstacle to expel air from the tube 25 through tubing 100 to switch 104 which sends an electrical signal through cord 24 to motor 32 to reverse the direction of rotation of shaft 28 and raise door 14.

Concerning the variant in FIG. 6, as the roll door 14 is unrolled and descends, wind bar 68 is lowered between channels 66 being supported by loops 74 and 76. Wind bar 68 thus extends across a face of roll door 14 directed to the interior of a building and functions as a brace against wind directed against the outer face of roll door 14. The door 14 can also be mounted so that wind bar 68 extends across a face of door 14 directed to the exterior of the building for the case in which air flow simulating wind is developed within the building.

It will be understood that the extent of travel of roll door 14 from the rolled or open configuration to the unrolled or closed configuration in which outer end 17 is in a lowermost position at floor level is predetermined and that reversal of motor 32 is not actuated by engagement of safety bar 22 with the floor, in the closed configuration.

The use of the hydraulic motor 32 avoids the need for a clutch or brakes and the hydraulic motor 32 is readily disengaged to permit manual rotation of shaft 28 to raise or lower door 14 during maintenance or power failure.

I claim:

1. A roll door assembly, comprising:

a frame comprising a pair of side frame members in spaced apart relationship, defining a door space therebetween said frame having an upper end and a lower end, rotatable support means for a flexible roll door mounted in said frame, a flexible roll door rollingly supported as a door winding on said support means, said support means being rotatably mounted in said upper end and said roll door being rollingly supported on said support means between an open door position in which said roll door is in a substantially rolled configuration having a minimum hanging weight of flexible door and a closed door position in which said roll door is in an unrolled configuration having a maximum hanging weight of flexible door extending vertically downwardly from said upper end to said lower end with an outer end of said roll door adjacent said lower end, a counterweight means housed in each of said frame members and adapted to retain said flexible roll door taut, said counterweight means being mounted for vertical counter-balancing movement responsive to rolling movement of said door, each said counterweight means comprising:

(i) a counterweight member, a first fixed pulley adjacent said upper end, a second fixed pulley adjacent said lower end, and a movable pulley mounted to said counterweight member between said first and second fixed pulley, (ii) spool means mounted for rotation with said support means, and (iii) a belt fixed at a first end to said spool means and wound thereon as a belt winding, and fixed at a second end to said outer end of said roll door, said belt being entrained from said spool means about said movable pulley, thence about said first fixed pulley and thence about said second fixed pulley to said outer end of said roll door, said belt winding on said spool means increasing in diameter responsive to decrease in diameter of said door winding on said support means as said roll door unwinds to the closed configuration and said hanging weight of flexible door increases, and said belt winding on said spool means decreasing in diameter responsive to increase in diameter of said door winding on said support means as said roll door is wound to the open configuration and said hanging weight of flexible door decreases, such that a uniform counter-balancing of said roll door is achieved throughout travel between said open and closed configurations by the balancing moment created by each said counterweight member and belt winding and by the hanging weight of flexible door and door winding, drive means to rotate said support and spool means, and further including opposed vertical channels in said side frame members, a wind bar extending between said channels for movement therein and support strand means entrained about said wind bar and mounted between said frame and said support means, said support strand means being rollingly supported on said support means.

2. A roll door assembly according to claim 1, including a pressure-sensitive element in said outer end adapted to initiate a signal in the event of engagement of said outer end with an object in said door space between said upper and lower ends, and means associated with said drive means to receive said signal and reverse the direction of rotation of said support means.

3. A roll door assembly according to claim 1, wherein said drive means comprises a hydraulic motor.

4. A roll door assembly according to claim 2, wherein said drive means comprises a hydraulic motor.

* * * * *